US010910796B2

(12) United States Patent
Gozawa

(10) Patent No.: US 10,910,796 B2
(45) Date of Patent: Feb. 2, 2021

(54) SPARK PLUG

(71) Applicant: NGK SPARK PLUG CO., LTD., Nagoya (JP)

(72) Inventor: Tatsuya Gozawa, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 16/868,852

(22) Filed: May 7, 2020

(65) Prior Publication Data

US 2020/0358261 A1 Nov. 12, 2020

(30) Foreign Application Priority Data

May 10, 2019 (JP) ..... 2019-089699

(51) Int. Cl.
*H01T 13/32* (2006.01)
*H01T 13/06* (2006.01)

(52) U.S. Cl.
CPC ..... *H01T 13/32* (2013.01); *H01T 13/06* (2013.01)

(58) Field of Classification Search
None
See application file for complete search history.

(56) References Cited

U.S. PATENT DOCUMENTS

| | | | | |
|---|---|---|---|---|
| 6,013,973 | A | 1/2000 | Sato | |
| 10,666,023 | B2 * | 5/2020 | Gozawa | H01T 13/32 |
| 10,714,904 | B2 * | 7/2020 | Gozawa | H01T 13/54 |
| 10,714,905 | B2 * | 7/2020 | Shigenaga | H01T 13/54 |
| 2015/0194793 | A1 * | 7/2015 | Yamanaka | H01T 13/32 313/141 |

FOREIGN PATENT DOCUMENTS

JP 11-224763 A 8/1999

* cited by examiner

*Primary Examiner* — Ashok Patel
(74) *Attorney, Agent, or Firm* — Leason Ellis LLP

(57) ABSTRACT

A spark plug includes: a center electrode; a ground electrode that is provided such that a gap for spark discharge is formed between the center electrode and the ground electrode; and a plug cover covering the center electrode and the ground electrode from a front side to form an auxiliary chamber, the plug cover being provided with a through hole, wherein 60% or more of the auxiliary chamber is present in a sphere. The sphere t has a center at a midpoint of a line segment connecting the center electrode and the ground electrode at a shortest distance on an axial line of the center electrode and is in contact with a point located closest from the center on an inner open end of the through hole is imagined.

11 Claims, 3 Drawing Sheets

SPARK PLUG

This application claims the benefit of priority to Japanese Patent Application No. 2019-089699, filed May 10, 2019, which is incorporated herein by reference in its entirety.

FIELD OF THE INVENTION

The present invention relates to a spark plug.

BACKGROUND OF THE INVENTION

As an ignition spark plug used for an internal combustion engine, for example, a gasoline engine, a spark plug provided with an auxiliary chamber covering a center electrode and a ground electrode from the front side has been known (for example, Japanese Patent Application Laid-Open (kokai) No. H11-224763).

Normally, a spark plug having an auxiliary chamber causes spark discharge in a spark gap, which is for causing a spark and is the gap between a center electrode and a ground electrode, and then flame is initially generated in the auxiliary chamber. Thereafter, the pressure in the auxiliary chamber is increased by the flame, and the flame jets out from the interior of the auxiliary chamber through a through hole to the outside of a plug cover due to the pressure. Then, fuel gas in a combustion chamber is burned using the flame having jetted out as an ignition source, whereby explosive combustion occurs in the combustion chamber.

Japanese Patent Application Laid-Open (kokai) No. H11-224763 discloses a spark plug in which a through hole of an auxiliary chamber is provided at the position of a spark gap in a direction along the axial line of the spark plug and a through hole is also provided at a position on the frontmost side of the auxiliary chamber.

Problems to be Solved by the Invention

However, in the spark plug described in Japanese Patent Application Laid-Open (kokai) No. H11-224763, after spark discharge, flame initially jets out from the through hole provided at the position of the spark gap, and then flame jets out from the through hole at the position on the frontmost side. Therefore, in the spark plug of Japanese Patent Application Laid-Open (kokai) No. H11-224763, before the pressure in the auxiliary chamber is sufficiently increased, the flame jets out from the through holes, and hence the jetting speed of the flame from the auxiliary chamber cannot be considered sufficiently high, resulting in a problem that the flame does not sufficiently spread in the combustion chamber and fuel economy is bad.

SUMMARY OF THE INVENTION

Means for Solving the Problems

The present invention has been made to solve the above-described problem and can be embodied in the following modes.

(1) According to an aspect of the present invention, a spark plug is provided. The spark plug includes: a center electrode; a ground electrode that is provided such that a gap for spark discharge is formed between the center electrode and the ground electrode; and a plug cover covering the center electrode and the ground electrode from a front side of the spark plug to form an auxiliary chamber, the plug cover being provided with a through hole, wherein, 60% or more of the auxiliary chamber is present in a sphere, which has a center at a midpoint of a line segment connecting the center electrode and the ground electrode at a shortest distance on an axial line of the center electrode and the sphere is in contact with a point, closest from the center, on an inner open end of the through hole. In the spark plug of this aspect, since 60% or more of the auxiliary chamber is present in the sphere having the center at a spark discharge ignition point, the pressure in the auxiliary chamber is sufficiently increased by flame generated in the auxiliary chamber. As a result, the jetting speed of the flame jetting out from the through hole is increased, and thus the flame sufficiently spreads in a combustion chamber, improving fuel economy.

(2) In the spark plug of the above aspect, 80% or more of the auxiliary chamber may be present in the sphere. In the spark plug of this aspect, the pressure in the auxiliary chamber is further increased by flame generated in the auxiliary chamber, resulting in improvement in fuel economy.

(3) The spark plug of the above aspect may further include: a tubular insulator disposed on an outer periphery of the center electrode; a tubular metal shell disposed on an outer periphery of the insulator; and a packing provided between the insulator and the metal shell. The insulator may include an insulator step portion projecting at the outer periphery thereof, the metal shell may include a metal shell inner step portion projecting at an inner periphery thereof, the insulator step portion may by in contact with the metal shell inner step portion via the packing, and at least a part of the metal shell inner step portion may be present in the sphere. In the spark plug of this aspect, the pressure in the auxiliary chamber is further increased by flame generated in the auxiliary chamber, resulting in improvement in fuel economy.

(4) In the spark plug of the above aspect, at least a part of the packing may be present in the sphere. In the spark plug of this aspect, the pressure in the auxiliary chamber is further increased by flame generated in the auxiliary chamber, resulting in improvement in fuel economy.

(5) In the spark plug of the above aspect, a plurality of the through holes may be provided, and the point on each of inner open ends of the plurality of the through holes may be present in an imaginary sphere obtained by multiplying a radius of the sphere by 1.1. In the spark plug of this aspect, the jetting speed of flame jetting out from each through hole can be made substantially equal, and thus uneven distribution of a region where fuel gas in the combustion chamber is burned can be inhibited, resulting in improvement in fuel economy.

The present invention can be embodied in various forms, and can be embodied, for example, in forms such as an engine head on which a spark plug is mounted.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

A. First Embodiment

Figure 1:
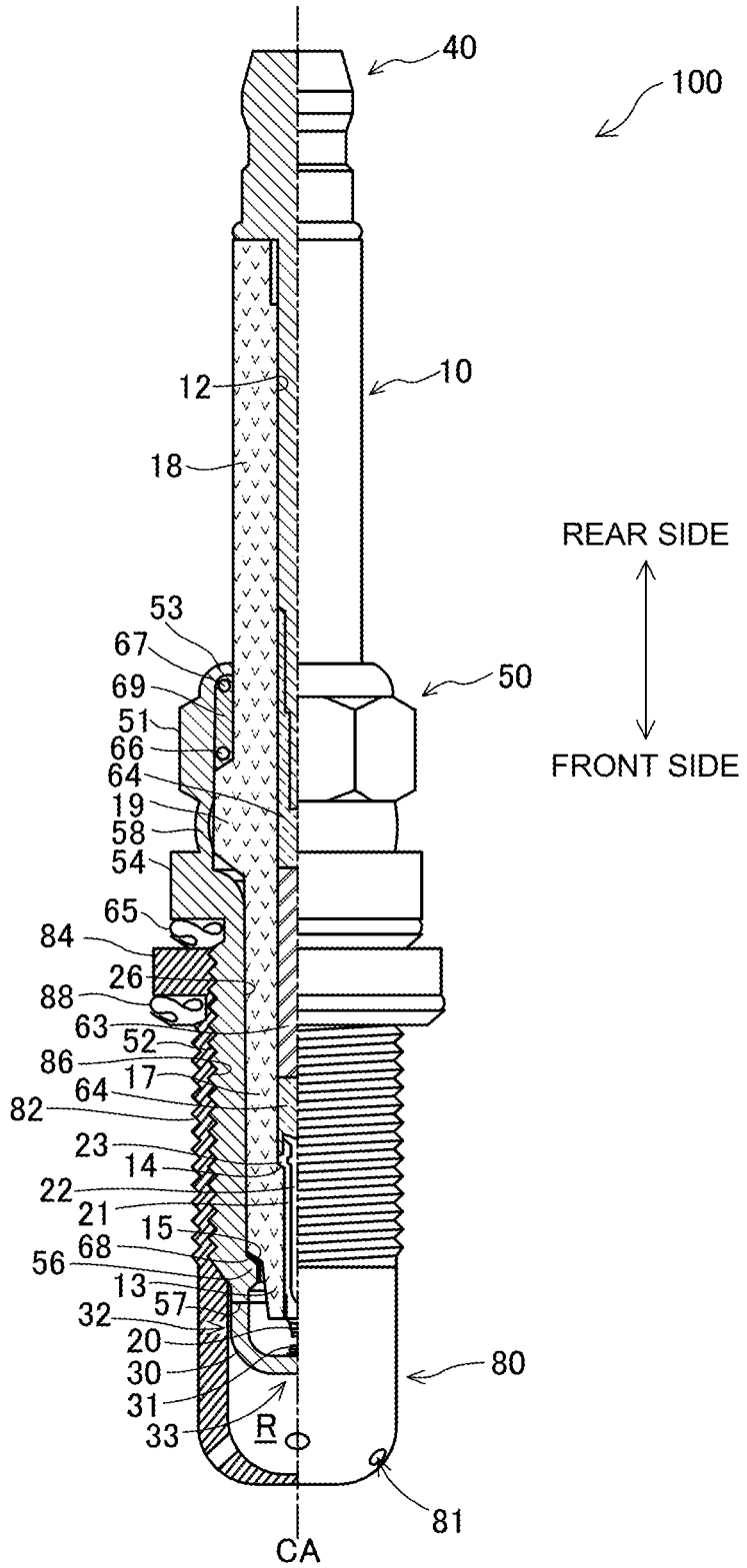
FIG. 1 is an explanatory diagram showing a partial cross section of a spark plug.

FIG. 1 is an explanatory diagram showing a partial cross section of a spark plug 100. In FIG. 1, with an axial line CA, which is the axis of the spark plug 100, as a boundary, the external appearance shape of the spark plug 100 is shown at the right side of the drawing sheet, and the cross-sectional shape of the spark plug 100 is shown at the left side of the drawing sheet. In the description of the present embodiment, the lower side of FIG. 1 is referred to as front side of the spark plug 100, and the upper side of FIG. 1 is referred to as rear side of the spark plug 100.

The spark plug 100 includes: an insulator 10 having an axial hole 12 along the axial line CA; a center electrode 20 provided in the axial hole 12; a tubular metal shell 50 disposed on the outer periphery of the insulator 10; a ground electrode 30 having a base end 32 fixed to the metal shell 50; and a plug cover 80 covering the center electrode 20 and the ground electrode 30. Here, the axial line CA of the spark plug 100 is the same as the axial line of the center electrode 20.

The insulator 10 is a ceramic insulator formed by firing a ceramic material such as alumina. The insulator 10 is a tubular member disposed on the inner periphery of the metal shell 50 and having the axial hole 12 that is formed at a center thereof and in which a part of the center electrode 20 is housed at the front side and a part of a metal terminal 40 is housed at the rear side. A central trunk portion 19 having a large outer diameter is formed at the center in the axial direction of the insulator 10. A rear trunk portion 18 having a smaller outer diameter than the central trunk portion 19 is formed at the rear side of the central trunk portion 19. A front trunk portion 17 having a smaller outer diameter than the rear trunk portion 18 is formed at the front side of the central trunk portion 19. A leg portion 13 having an outer diameter that decreases toward the center electrode 20 side is formed at the further front side of the front trunk portion 17.

The metal shell 50 is a cylindrical metal member that surrounds and holds a portion, of the insulator 10, extending from a part of the rear trunk portion 18 to the leg portion 13. The metal shell 50 is, for example, formed from low-carbon steel, and entirely plated with nickel, zinc, or the like. The metal shell 50 includes a tool engagement portion 51, a seal portion 54, and a mounting screw portion 52 in this order from the rear side. A tool for mounting the spark plug 100 to an engine head is fitted to the tool engagement portion 51. The mounting screw portion 52 is a portion that has an external thread formed on the outer periphery of the metal shell 50 over the entire circumference thereof and that is screwed into a screw groove 86 of the plug cover 80. The seal portion 54 is a portion formed in a flange shape at the root of the mounting screw portion 52. An annular gasket 65 formed by bending a plate is inserted and fitted between the seal portion 54 and a cover seal portion 84 of the plug cover 80. An end surface 57, at the front side, of the metal shell 50 has a hollow circular shape, and the front end of the leg portion 13 of the insulator 10 and the front end of the center electrode 20 project from the center of the end surface 57.

A crimp portion 53 having a small thickness is provided at the rear side with respect to the tool engagement portion 51 of the metal shell 50. In addition, a compressive deformation portion 58 having a small thickness similar to the crimp portion 53 is provided between the seal portion 54 and the tool engagement portion 51. Annular ring members 66 and 67 are interposed between the inner peripheral surface of the metal shell 50 and the outer peripheral surface of the rear trunk portion 18 of the insulator 10 from the tool engagement portion 51 to the crimp portion 53, and the space between these ring members 66 and 67 is further filled with powder of talc 69. During manufacturing of the spark plug 100, the compressive deformation portion 58 becomes compressively deformed by pressing the crimp portion 53 to the front side such that the crimp portion 53 is bent inward. Due to the compressive deformation of the compressive deformation portion 58, the insulator 10 is pressed within the metal shell 50 toward the front side via the ring members 66 and 67 and the talc 69. Due to the pressing, the talc 69 is compressed in the axial line CA direction, whereby the airtightness in the metal shell 50 is increased.

The metal shell 50 has a metal shell inner step portion 56 formed so as to project on the inner periphery of the metal shell 50. In addition, the insulator 10 has an insulator step portion 15 located at the rear end of the leg portion 13 and formed so as to project on the outer periphery of the insulator 10. On the inner periphery of the metal shell 50, the metal shell inner step portion 56 is in contact with the insulator step portion 15 via an annular packing 68. The packing 68 is a member for maintaining the airtightness between the metal shell 50 and the insulator 10, and prevents outflow of fuel gas. In the present embodiment, a plate packing is used as the packing.

The center electrode 20 is a rod-shaped member in which a core material 22 having better thermal conductivity than an electrode member 21 is embedded inside the electrode member 21. The electrode member 21 is formed from a nickel alloy containing nickel as a main component, and the core material 22 is formed from copper or an alloy containing copper as a main component. For example, a noble metal tip formed from an iridium alloy or the like may be joined to an end portion, at the front side, of the center electrode 20.

A flange portion 23 is formed near an end portion, at the rear side, of the center electrode 20 so as to project at the outer peripheral side of the center electrode 20. The flange portion 23 is in contact with an axial hole inner step portion 14, which projects at the inner peripheral side in the axial hole 12 of the insulator 10, from the rear side, and positions the center electrode 20 within the insulator 10. The center electrode 20 is electrically connected at the rear side thereof to the metal terminal 40 via a seal body 64 and a ceramic resistor 63.

The ground electrode 30 is formed from an alloy containing nickel as a main component. The base end 32 of the ground electrode 30 is fixed to the end surface 57 of the metal shell 50. The ground electrode 30 extends along the axial line CA from the base end 32 toward the front side, and is bent at an intermediate portion thereof such that one side surface of a front end portion 33 of the ground electrode 30 faces the front end surface of the center electrode 20. A noble metal tip 31 is provided on the surface, of the front end portion 33 of the ground electrode 30, which faces the center electrode 20 side. A gap for spark discharge is formed between the noble metal tip 31 of the ground electrode 30 and the center electrode 20. Hereinafter, this gap is also referred to as "spark gap". The noble metal tip 31 is formed from, for example, platinum, iridium, ruthenium, rhodium, or an alloy thereof.

The plug cover 80 is a member covering the center electrode 20 and the ground electrode 30 from the front side to form an auxiliary chamber R. The plug cover 80 of the present embodiment is formed from stainless steel. The auxiliary chamber R covers the spark gap. In the present embodiment, the auxiliary chamber R is a space surrounded by the insulator 10, the center electrode 20, the metal shell 50, the packing 68, and the plug cover 80. The screw groove 86 which is threadedly engaged with the mounting screw portion 52 of the metal shell 50 is formed on an inner wall of the plug cover 80, and the plug cover 80 is mounted to the metal shell 50 by screwing the metal shell 50 into the plug cover 80.

The plug cover 80 includes a screw portion 82 and the cover seal portion 84. The screw portion 82 is a portion that has an external thread formed on the outer periphery of the plug cover 80 over the entire circumference thereof and that is screwed into a screw groove of the engine head. The cover seal portion 84 is a portion formed in a flange shape at the root of the screw portion 82. An annular gasket 88 formed by bending a plate is inserted and fitted at the front side of the cover seal portion 84. The thickness of the plug cover 80 is not particularly limited, but may be, for example, about 1.5 mm to 3 mm.

The plug cover 80 is provided with a plurality of through holes 81 providing communication between the inside and the outside of the plug cover 80. By providing the through holes 81, fuel gas that is present in a combustion chamber of an engine can be caused to flow into the auxiliary chamber R, the fuel gas in the auxiliary chamber R can be ignited by a spark caused in the auxiliary chamber R, to generate flame, and the flame can be jetted to the outside of the plug cover 80.

Figure 2:
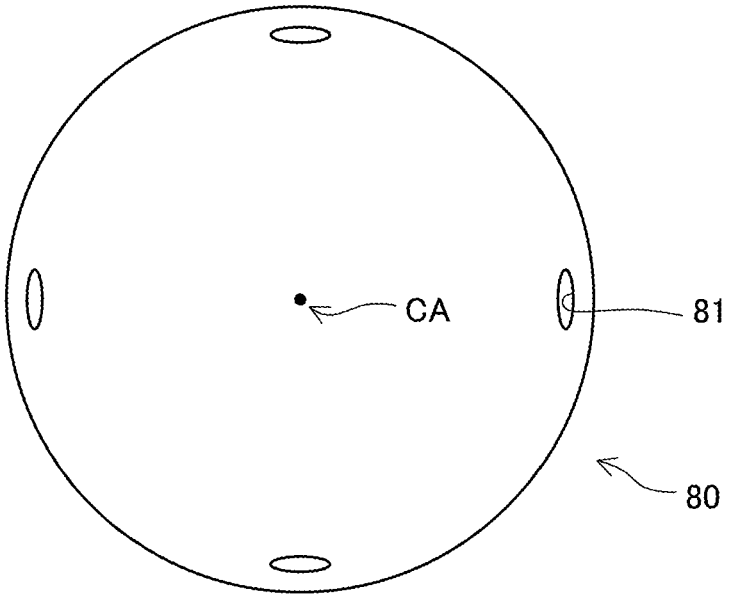
FIG. 2 is a schematic diagram of a plug cover as seen from a front side.

FIG. 2 is a schematic diagram of the plug cover 80 as seen from the front side. In the present embodiment, four through holes 81 are provided at equal intervals around the axial line CA. The number of through holes 81 is not limited thereto, and may be 3 or less or may be 5 or more. From the viewpoint of improvement in fuel economy, the number of through holes 81 is preferably equal to or greater than 2 and equal to or less than 8, and more preferably equal to or greater than 3 and equal to or less than 6.

Figure 3:
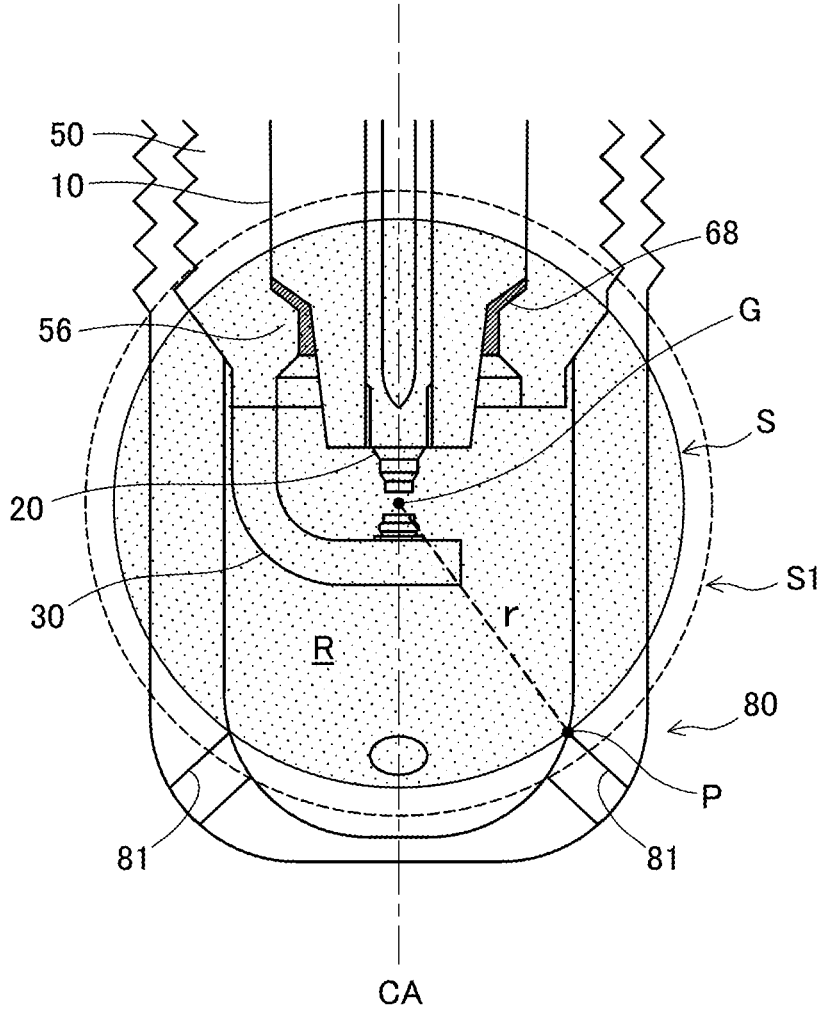
FIG. 3 is an enlarged view of an auxiliary chamber.

FIG. 3 is an enlarged view of the auxiliary chamber R. Here, a sphere S having a center G at a point that is the midpoint of a line segment connecting the center electrode 20 and the ground electrode 30 at the shortest distance on the axial line CA of the center electrode 20, is imagined. The sphere S is a sphere that is in contact with the point P, closest from the center G, on the inner open end of the through hole 81. That is, the radius r of the sphere S is a line segment from the center G to the point P. In the case where the spark plug 100 has a plurality of through holes 81, the points, closest from the center G, on the inner open ends of the plurality of through holes 81 are points P.

In the present embodiment, 60% or more of the auxiliary chamber R is present in the sphere S. Here, the volume of the auxiliary chamber R means the volume of the space surrounded by the insulator 10, the center electrode 20, the metal shell 50, the packing 68, and the plug cover 80. The volume of the auxiliary chamber R does not include the volumes of the through holes 81. The volume of the auxiliary chamber R can be calculated from a 3D image of the auxiliary chamber R obtained by scanning the interior of the auxiliary chamber R using an X-ray CT scanner under the conditions of a maximum tube voltage of 200 kV and a maximum tube current of 120 μA. In addition, the volume of the sphere S can be calculated by calculating the radius r of the sphere S from this 3D image. In the spark plug 100 of the present embodiment, the volume of the auxiliary chamber R is 450 $mm^3$, the volume of the sphere S is 1276 $mm^3$, and 92% of the auxiliary chamber R is present in the sphere S.

In the spark plug 100 of the present embodiment, spark discharge is caused in the spark gap, and then flame is initially generated in the auxiliary chamber R. Thereafter, the pressure in the auxiliary chamber R is increased by the flame, and the flame jets out through the through holes 81 to the outside of the plug cover 80 due to this pressure. Then, fuel gas in the combustion chamber is burned using the flame having jetted out as an ignition source, whereby explosive combustion occurs in the combustion chamber.

In the spark plug 100 of the present embodiment, since 60% or more of the volume of the auxiliary chamber R is present in the sphere S having a center at the point G which is a spark discharge ignition point, the pressure in the auxiliary chamber R at the time of ignition is higher as compared to the case where less than 60% of the volume of the auxiliary chamber R is present in the sphere S. The jetting speed of flame to the outside of the auxiliary chamber R is due to the pressure difference between the pressure in the auxiliary chamber R and the pressure in the combustion chamber. In the present embodiment, the jetting speed of the flame can be increased, and, as a result, the flame can be spread throughout the combustion chamber, so that fuel economy is improved. From the viewpoint of further improvement in fuel economy, 70% or more of the auxiliary chamber R is preferably present in the sphere S, and 80% or more of the auxiliary chamber R is more preferably present in the sphere S. The upper limit of the auxiliary chamber R present in the sphere S is not particularly limited, but is preferably equal to or less than 100%.

Moreover, in the spark plug 100 according to the present embodiment, the metal shell inner step portion 56 is present in the sphere S. In the spark plug 100 of this embodiment, since the volume of the auxiliary chamber R at the rear side with respect to the center G is decreased, the pressure in the auxiliary chamber R at the time of ignition is further increased, and a combustion speed is increased, so that fuel economy is improved.

Moreover, in the spark plug 100 according to the present embodiment, the packing 68 is present in the sphere S. In the spark plug 100 of this embodiment, since the volume of the auxiliary chamber R at the rear side with respect to the center G is decreased, the pressure generated at the time of ignition can be efficiently propagated to the through holes 81. The metal shell inner step portion 56 does not have to be included in the sphere S.

Moreover, in the spark plug 100 according to the present embodiment, the point, closest from the center G, on each of the inner open ends of the plurality of through holes 81 is present in an imaginary sphere S1 obtained by multiplying the radius r of the sphere S by 1.1. In general, flame propagates substantially concentrically from the ignition point. In the spark plug 100 of this embodiment, the pressure generated at the time of ignition propagates substantially equally to each through hole 81. As a result, the length of flame jetting out from each through hole 81 can be made substantially equal, and thus uneven distribution of a region where fuel gas in the combustion chamber is burned can be inhibited, resulting in improvement in fuel economy.

Moreover, in the spark plug 100 according to the present embodiment, a part of a side wall of the plug cover 80 is present in the sphere S. In the spark plug 100 of this embodiment, when the pressure generated at the time of ignition propagates to the through holes 81, the pressure also reaches the side wall present in the sphere S, and thus the pressure in the auxiliary chamber R is increased. As a result, the length of flame jetting out from the through holes 81 can be increased. Thus, the combustion speed of fuel gas in the combustion chamber can be increased, so that fuel economy is improved.

B. Other Embodiments

The present invention is not limited to the above-described embodiment and can be embodied in various configurations without departing from the gist of the present invention. For example, the technical features in the embodiment corresponding to the technical features in each aspect described in the Summary of the Invention section can be appropriately replaced or combined to solve part or all of the foregoing problems, or to achieve part or all of the foregoing effects. Further, such technical features can be appropriately deleted if not described as being essential in the present specification.

In the above-described embodiment, the metal shell 50 and the plug cover 80 are separate members, but are not limited thereto and may be integrated with each other. In addition, the ground electrode 30 is provided to the metal shell 50, but is not limited thereto and may be provided, for example, to the plug cover 80.

In the above-described embodiment, the metal shell inner step portion 56 is present in the sphere S, but is not limited thereto. The metal shell inner step portion 56 does not have to be included in the sphere S. However, from the viewpoint of improvement in fuel economy, at least a part of the metal shell inner step portion 56 is preferably present in the sphere S.

In the above-described embodiment, the packing 68 is present in the sphere S, but is not limited thereto. The packing 68 does not have to be included in the sphere S. However, from the viewpoint of improvement in fuel economy, at least a part of the packing 68 is preferably present in the sphere S.

In the above-described embodiment, as shown in FIG. 3, the metal shell inner step portion 56 projects at the inner peripheral side with respect to a portion, at the front side, of the metal shell inner step portion 56 and a portion, at the rear side, of the metal shell inner step portion 56. However, the metal shell inner step portion 56 is not limited thereto. The metal shell inner step portion 56 only has to project at the inner peripheral side with respect to the portion, at the rear side, of the metal shell inner step portion 56.

In the above-described embodiment, as shown in FIG. 3, the point, closest from the center G, on each of the inner open ends of the plurality of through holes 81 is present in the imaginary sphere S1. However, the point is not limited thereto. The point, closest from the center G, on each of the inner open ends of the plurality of through holes 81 does not have to be present in the imaginary sphere S1.

DESCRIPTION OF REFERENCE NUMERALS

10: insulator
12: axial hole
13: leg portion
14: axial hole inner step portion
15: insulator step portion
17: front trunk portion
18: rear trunk portion
19: central trunk portion
20: center electrode
21: electrode member
22: core material
23: flange portion
30: ground electrode
31: noble metal tip
32: base end
33: front end portion
40: metal terminal
50: metal shell
51: tool engagement portion
52: mounting screw portion
53: crimp portion
54: seal portion
56: metal shell inner step portion
57: end surface
58: compressive deformation portion
63: ceramic resistor
64: seal body
65: gasket
66, 67: ring member
68: packing
69: talc
80: plug cover
81: through hole
82: screw portion
84: cover seal portion
86: screw groove
88: gasket
100: spark plug
CA: axial line
G: center
R: auxiliary chamber
S: sphere
S1: imaginary sphere
r: radius

The invention claimed is:

1. A spark plug comprising:
a center electrode;
a ground electrode that is provided such that a gap for spark discharge is formed between the center electrode and the ground electrode; and
a plug cover covering the center electrode and the ground electrode from a front side of the spark plug to form an auxiliary chamber, the plug cover being provided with at least one through hole, wherein
when a sphere is imagined, said sphere having a center at a midpoint of a line segment connecting the center electrode and the ground electrode at a shortest distance on the axial line of the center electrode, and being in contact with a point located closest from the center on an inner open end of the through hole, the plug cover is configured such that 60% or more of the volume of the auxiliary chamber is present in the sphere.

2. The spark plug according to claim 1, wherein the plug cover is configured such that 80% or more of the volume of the auxiliary chamber is present in the sphere.

3. The spark plug according to claim 1, further comprising:
a tubular insulator disposed on an outer periphery of the center electrode;
a tubular metal shell disposed on an outer periphery of the insulator; and
a packing provided between the insulator and the metal shell, wherein
the insulator includes an insulator step portion projecting at the outer periphery thereof, the metal shell includes a metal shell inner step portion projecting at an inner periphery thereof, the insulator step portion is in contact with the metal shell inner step portion via the packing, and at least a part of the metal shell inner step portion is present in the sphere.

4. The spark plug according to claim 3, wherein at least a part of the packing is present in the sphere.

5. The spark plug according to claim 1, wherein a plurality of the at least one through holes are provided, and the point on each of inner open ends of the plurality of the through holes is present in an imaginary sphere obtained by multiplying a radius of the sphere by 1.1.

6. The spark plug according to claim 2, further comprising:

a tubular insulator disposed on an outer periphery of the center electrode;

a tubular metal shell disposed on an outer periphery of the insulator; and a packing provided between the insulator and the metal shell, wherein the insulator includes an insulator step portion projecting at the outer periphery thereof, the metal shell includes a metal shell inner step portion projecting at an inner periphery thereof, the insulator step portion is in contact with the metal shell inner step portion via the packing, and at least a part of the metal shell inner step portion is present in the sphere.

7. The spark plug according to claim 2, wherein a plurality of the at least one through holes are provided, and the point on each of inner open ends of the plurality of the through holes is present in an imaginary sphere obtained by multiplying a radius of the sphere by 1.1.

8. The spark plug according to claim 3, wherein a plurality of the at least one through holes are provided, and the point on each of inner open ends of the plurality of the through holes is present in an imaginary sphere obtained by multiplying a radius of the sphere by 1.1.

9. The spark plug according to claim 4, wherein a plurality of the at least one through holes are provided, and the point on each of inner open ends of the plurality of the through holes is present in an imaginary sphere obtained by multiplying a radius of the sphere by 1.1.

10. The spark plug according to claim 6, wherein a plurality of the at least one through holes are provided, and the point on each of inner open ends of the plurality of the through holes is present in an imaginary sphere obtained by multiplying a radius of the sphere by 1.1.

11. The spark plug according to claim 1, wherein a part of a side wall of the plug cover is included in the sphere.

* * * * *